United States Patent [19]

Holman

[11] 4,407,529

[45] Oct. 4, 1983

[54] SELF-LOCKING COUPLING NUT FOR ELECTRICAL CONNECTORS

[75] Inventor: Howard E. Holman, Fort Worth, Tex.

[73] Assignee: T. J. Electronics, Inc., Arlington, Tex.

[21] Appl. No.: 209,429

[22] Filed: Nov. 24, 1980

[51] Int. Cl.[3] ..... H01R 13/54

[52] U.S. Cl. ..... 285/82; 285/93; 285/388; 339/89 R; 339/DIG. 2

[58] Field of Search ..... 285/82, 84, 85, 81, 285/93, 386, 388; 339/89 R, 89 M, DIG. 2

[56] References Cited

U.S. PATENT DOCUMENTS

| | | |
|---|---|---|
| 562,029 | 6/1896 | Rinsche . |
| 794,766 | 1/1904 | Wright et al. . |
| 975,905 | 11/1910 | Taylor . |
| 1,289,867 | 12/1918 | Moore . |
| 1,467,907 | 9/1923 | Miyagi . |
| 2,372,888 | 4/1945 | Duggan . |
| 2,688,736 | 9/1954 | Simpson . |
| 3,069,187 | 12/1962 | Collins et al. . |
| 3,255,796 | 6/1966 | Tobey . |
| 3,343,852 | 9/1967 | Blight et al. . |
| 3,393,927 | 8/1968 | Kelly et al. . |
| 3,462,727 | 8/1969 | Blight et al. . |
| 3,552,777 | 1/1971 | Heinrich et al. . |
| 3,587,032 | 6/1971 | Norman . |
| 3,594,700 | 7/1971 | Nava et al. . |
| 3,601,764 | 8/1971 | Cameron . |
| 3,669,472 | 6/1972 | Nadsady . |
| 3,808,580 | 4/1974 | Johnson . |
| 4,109,990 | 5/1977 | Waldron et al. . |
| 4,290,662 | 9/1981 | Storcel ..... 339/DIG. 2 X |

FOREIGN PATENT DOCUMENTS

| | | |
|---|---|---|
| 467544 | 10/1928 | Fed. Rep. of Germany . |
| 1221842 | 1/1960 | France . |
| 2002273 | 10/1969 | France . |

*Primary Examiner*—Thomas F. Callaghan
*Attorney, Agent, or Firm*—Michael A. O'Neil

[57] ABSTRACT

A self-locking coupling nut (14) includes a nut surrounding a first shell (12) for threaded engagement with a second shell (66) to secure the shells in mating engagement. A plurality of balls (52) mounted in the nut are initially engaged with a ball receiving surface (24) on the first shell, and upon threaded engagement between the nut and second ball are cammed outwardly into ball receiving grooves (32) to secure the nut against inadvertent disengagement from the second ball. Outward movement of the balls cams a spring (56) outwardly to provide visual and tactile proof of the locked condition of the self-locking coupling nut. Threaded engagement of the nut with the second shell also compresses a spring between a thrust ring (20) on the first shell and a retaining ring (44) on the nut.

21 Claims, 7 Drawing Figures

SELF-LOCKING COUPLING NUT FOR ELECTRICAL CONNECTORS

TECHNICAL FIELD

This invention relates to a self-locking coupling nut for electrical connectors which provides visual and tactile proof of the locked condition.

BACKGROUND AND SUMMARY OF THE INVENTION

When an engine or other equipment is installed in an aircraft, submarine, or other apparatus, it is necessary to establish numerous electrical connections between such equipment and various controls, gauges, etc. located elsewhere on the apparatus in which it is installed. These electrical connections must be readily disengagable in order to facilitate service or replacement of the equipment. On the other hand, it is essential that the electrical connections do not become disengaged during operation of the apparatus because of vibration, shock, etc.

These requirements were originally fulfilled by means of threaded electrical connectors that were secured by safety wires. However, the use of safety wire-type connectors proved to be time consuming and therefore expensive. Also, the installation of safety wires can be difficult or impossible when the connector is situated in a remote location.

These and other difficulties associated with use of safety wire-type electrical connectors led to the development of various self-locking devices for use with electrical connectors. Such self-locking devices usually include at least two members adapted for threaded engagement to secure the electrical connector in the engaged condition and a detent apparatus for preventing disengagement of the threaded members except in response to a predetermined force. The detenting apparatus may operate either in the radial direction, for example, the devices shown in U.S. Pat. Nos. 3,587,030; 3,594,700; 3,601,764 and 4,109,990, or in the axial direction, for example, the devices shown in U.S. Pat. Nos. 3,069,187; 3,462,727; 3,552,777; 3,594,700; 3,808,580 and French Pat. No. 2,002,273.

The prior art reference which is perhaps the most pertinent to the present invention is Blight et al. U.S. Pat. No. 3,343,852 granted Sept. 26, 1967. In the Blight et al. device a plurality of spring loaded balls engage a gear tooth to provide ratcheting action. This in turn prevents the disengagement of a pair of threaded members which retain mating electrical connectors in the engaged condition.

In the devices disclosed in most of the above-listed patents, the detenting apparatus operates continuously. That is, the detenting apparatus functions throughout the threaded engagement, and throughout the subsequent threaded disengagement, of the members which secure the electrical connectors in engagement with one another. Such continuous detent apparatus operation causes unnecessary resistance to the initial phase of the threaded engagement of the connector securing members.

Another deficiency that has been experienced in prior art self-locking coupling devices adapted for use with electrical connectors (such as Blight et al.) relates to the lack of any structure which provides visual or tactile proof of the fully locked status of the device. Thus, although fully locked status is readily ascertainable both when the electrical connector securing members are being threadedly engaged and when an attempt is made to threadedly disengage the members, nothing is provided in most of the prior art self-locking coupling devices to provide visual or tactile proof of the locked status of the device.

The present invention comprises a self-locking coupling nut which overcomes the foregoing and other difficulties long since associated with the prior art. In accordance with the broader aspects of the invention, electrical connector securing members are maintained in threaded engagement by a plurality of spring loaded balls which engage spaced apart grooves. However, the spring loaded balls do not engage the grooves until the coupling nut is substantially fully engaged. In this manner the initial threaded engagement between the electrical connector securing members is substantially facilitated.

In accordance with another aspect of the invention, the spring loading of the balls is provided by a circular spring extending around and engaging each of the balls. When the electrical connector securing members are disengaged, the circular spring is enclosed within a groove. As the electrical connector securing members become fully engaged and the balls enter the spaced apart grooves to restrain disengagement thereof, the spring is cammed outwardly to a position wherein it extends beyond the slot. The positioning of the spring thus provides visual and tactile proof of the fully locked condition of the coupling nut.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
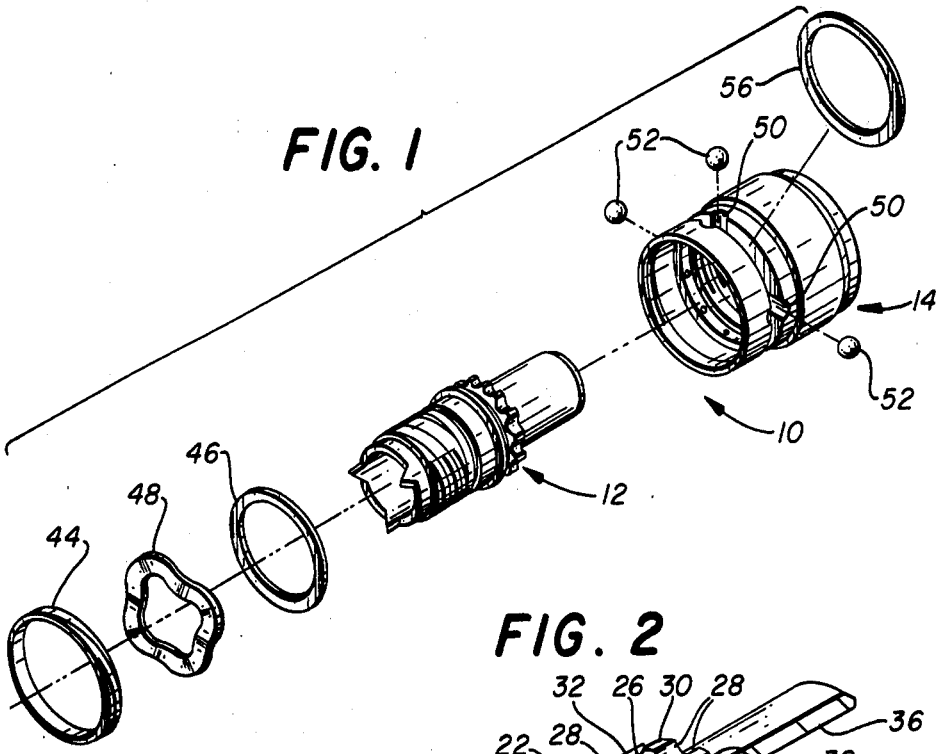
FIG. 1 is an exploded view illustrating the first shell and the nut of the invention.
Figure 2:
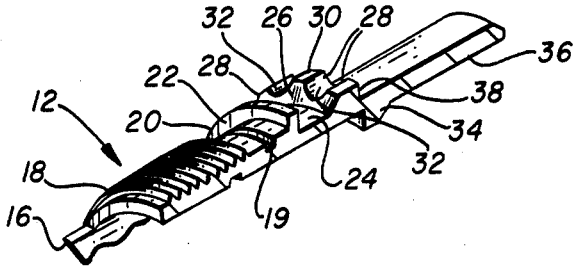
FIG. 2 is a longitudinal sectional view of the first shell.
Figure 3:
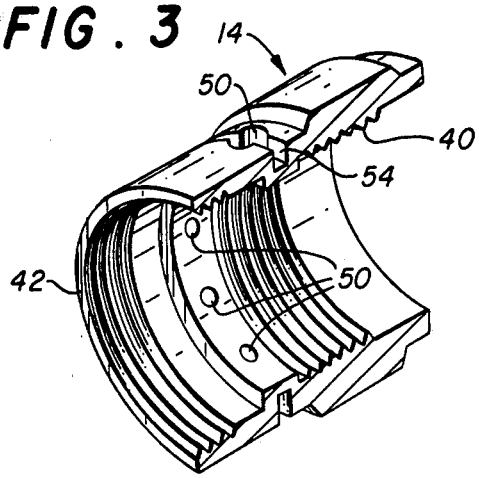
FIG. 3 is a longitudinal sectional view of the nut.

Referring now to the drawings, and particularly to FIGS. 1 2 and 3 thereof, there is shown a self-locking coupling nut 10 incorporating the present invention. The self-locking coupling nut 10 includes a first shell 12 and a nut 14 which is normally positioned in a coaxial and overlying relationship with respect to the first shell 12.

Referring particularly to FIG. 2, the first shell 12 is preferably from metal, for example, stainless steel or aluminum, although other types of materials may be used in fabricating the first shell 12, if desired. The first shell 12 is provided with projections 16 at one end thereof. Threads 18 are formed on the exterior of the first shell 12 adjacent the projections 16. The projections 16 and the threads 18 are adapted to secure the first shell 12 to a cable. The projections 16 and the threads 18 are conventional, and do not form part of the present invention.

A groove 19 is formed in the first 12 and extender around its circumference. The first shell 12 has a thrust ring 20 extending around the entire circumference thereof. The thrust ring 20 includes a radially extending, axially facing thrust surface 22.

Positioned adjacent the thrust ring 20 is a radially inwardly located, axially extending ball receiving surface 24. The surface 24 extends to a ball camming surface 26 which inclines angularly outwardly from the surface 24. The surface 26 extends outwardly to a plurality of lands 28, each having an axially extending, cylindrically shaped, outer surface. 30. Adjacent lands 28 are separated by a ball receiving groove 32 which is arcuate in shape.

The first shell 12 further includes a locating collar 34. A tubular portion 36 extends beyond the collar 34. A second shell engaging surface 38 is formed at the intersection of the lands 28 and the tubualar portion 36.

Referring now to FIGS. 1 and 3, the nut 14 is likewise preferably formed from metal, for example, stainless steel or aluminum, although other types of materials may be used in the manufacture of the nut 14, if desired. The nut 14 is internally threaded at 40 for threaded engagement with corresponding threads on a second shell (not shown in FIGS. 1 or 3). The nut 14 is also internally threaded at 42 to threadedly engage an externally threaded retaining ring 44.

A thrust washer 46 normally surrounds the first shell 12 and is adapted for engagement with the thrust surface 22 of the thrust ring 20. The thrust washer 46 has an inside diameter that is smaller than the outside diameter of the thrust ring 20. Therefore, the thrust washer 46 cannot pass the thrust ring 20 of the first shell 12.

A sinusoidal or wave-shaped spring 48 is also normally positioned around the first shell 12. The wave-shaped spring 48 has an outside dimension which is greater than the inside diameter of the thrust washer 46, and which is also greater than the inside diameter of the retaining ring 44. Thus, when the nut 14 is positioned around the first shell 12 and the retaining ring 44 is threadedly engaged with the threads 42 of the nut 14, the wave-shaped spring 48 is trapped between the thrust washer 46 and the retaining ring 44, and axial movement of the thrust washer 46 is limited by the thrust ring 20.

The nut 14 further includes a plurality of ball receiving apertures 50. A ball 52 is received in each of the apertures 50 and is freely movable axially therein. A circumferential spring receiving groove 54 is formed in the nut 14 and interconnects all of the ball receiving apertures 50. An annular spring 56 is normally received in the groove 54 and functions to retain the balls 52 in the apertures 50. The spring 56 comprises a flat spiral that is radially expandable both for assembly into the groove 54 and during operation of the self-locking coupling nut.

Figure 4:
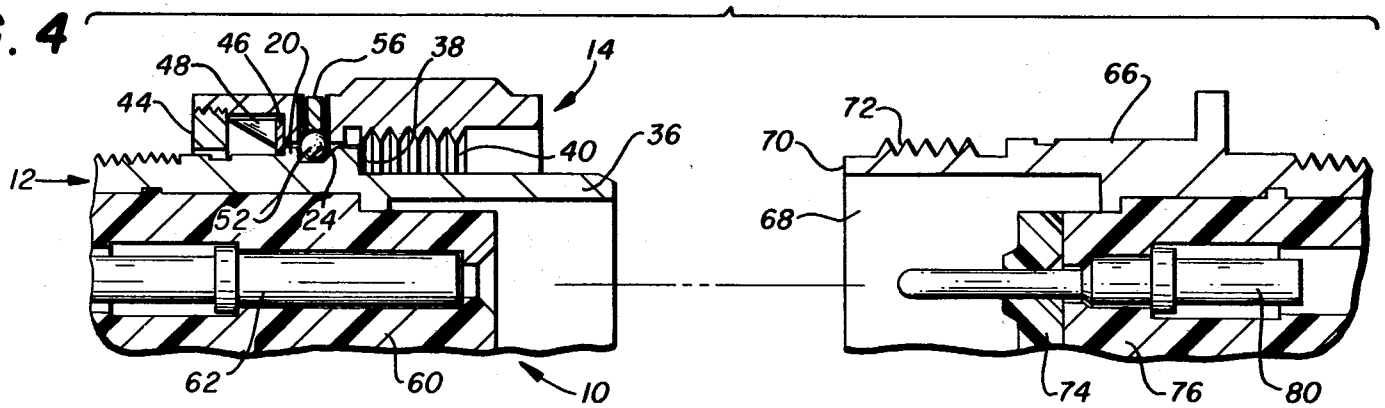
FIG. 4 is a longitudinal section view of the self-locking coupling nut of the present invention showing the disengaged state thereof.

Referring now to FIG. 4, the first shell 12 and the nut 14 are shown in the assembled state. The wave-shaped spring 48 and the thrust washer 46 are retained by the retaining ring 44 which is threadedly engaged with the nut 14. At this point the thrust washer 46 is engaged with the thrust ring 20 under slight pressure. The balls 52 are aligned with the surface 24 and are retained in engagement therewith by the spring 56. It will therefore be understood that other than a very limited amount of rolling friction caused by the engagement of the balls 52 with the surface 24, the nut 14 is freely rotatable relative to the first shell 12.

The first shell 12 receives and retains electrically insulative components 60 and electrically conductive components 62 mounted therein. The components 60 and 62 are conventional, and do not form part of the present invention. It will be understood that the interior configuration and dimensions of the first shell 12 may be altered as necessary to accommodate the components 60 and 62 that are desired for a particular application of the present invention.

FIG. 4 further illustrates a second shell 66 adapted for mating and locking engagement with the first shell 12 and the nut 14 comprising the self-locking coupling nut 10 of the present invention. The second shell 16 is preferably formed from metal, for example, stainless steel or aluminum. However, the second shell 16 may be formed from other materials in accordance with particular requirements.

The second shell 66 includes a tubular extension 68 having a first shell engaging surface 70 at one end thereof. The interior of the extension 68 of the second shell 66 is dimensioned to receive the tubular extension 36 of the first shell 12 therein. The exterior of the tubular extension 68 is provided with external threads 72 which are dimensioned and adapted for mating threaded engagement with the internal threads 40 of the nut 14.

The interior of the second shell 66 receives electrically insulative components 74 and 76 and electrically conductive components 80. The function of the self-locking coupling nut 10 of the present invention is to secure the components 80 of the second shell 66 in electrically conductive engagement with the components 62 of the first shell 12. The interior configuration and dimensions of the second shell 66 may be altered in order to suit the requirements of the components 74, 76 and 80 that are to be utilized in a particular application of the invention.

Figure 5:
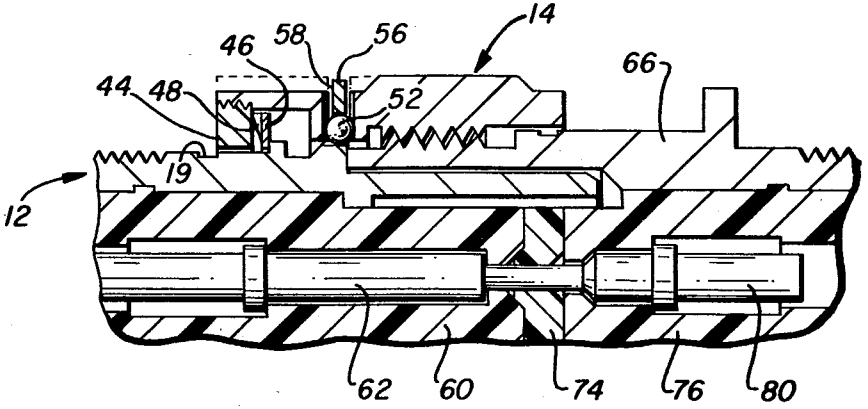
FIG. 5 is a view similar to FIG. 4 showing the engaged state of the self-locking coupling nut.

FIG. 5 illustrates the component parts of the self-locking coupling nut 10 in the assembled state. The tubular extension 36 of the first shell 12 is initially inserted into the tubular extension 68 of the second shell 66, and the two components are moved toward one another. This causes the threads 72 of the second shell 66 to come into engagement with the threads 40 of the nut 14. The nut 14 is then rotated in order to establish a threaded connection between the threads 72 and 40 and thereby secure the engagement between the first shell 12 and the components 60 and 62 carried thereby and the second shell 66 and the components 74, 76 and 80 carried thereby. The initial threaded engagement between the nut 14 and the second shell 66 is facilitated because at this point the nut 14 is relatively freely rotatable on the first shell 12.

When the surface 70 of the second shell 66 engages the surface 38 of the first shell 12, further movement of the shells 66 and 12 towards each other is prevented. Thereafter, further rotation of the nut 14 causes axial movement of the nut 14 relative to the first shell 12. Upon axial movement of the nut 14 rightwardly (FIGS. 4 and 5) relative to the first shell 12, the wave-shaped spring 48 is compressed between the thrust washer 46 and the retaining ring 44 of the nut 14. As the spring 48 is compressed a predetermined force is applied between the external threads 72 of the second shell 76 and the matingly engaged internal threads 40 of the nut 14.

Relative axial movement rightwardly (FIGS. 4 and 5) of the nut 14 with respect to the firt shell 12 also causes the balls 52 to move upwardly on the camming surface 26 of the first shell 12 against the action of the spring 56. As the nut 14 moves further rightwardly the balls 52 enter the grooves 32 between the lands 28. Thereafter, rotation of the nut 14 relative to the first shell 12 in either direction can only occur by generating sufficient force to move the balls upwardly and out of the grooves 32, across the surfaces 30 of the lands 28, and into the next adjacent grooves 32. This movement is resisted by the spring 56 which generates a predetermined force that urges the balls 52 to move radially inwardly. By this means any possibility of accidental disengagement of the component parts of the self-locking coupling nut 10 due to vibration, etc., is completely eliminated. Likewise, the inadvertent disengagement of the component parts of the self-locking coupling nut 10 due to accidental rotation of the nut 14 is prevented, since it is necessary to apply a predetermined torque to the nut 14 in order to effect rotation thereof with respect to the first shell 12 and the second shell 66.

Unlike various prior art self-locking coupling nut designs, initial rotation of the nut 14 of the present invention to lock the first shell 12 in engagement with the second shell 66 does not cause a ratcheting and/or detent effect. However, after the balls 52 initially enter the grooves 32, further rotation of the nut 14 causes ratcheting and/or detenting. This effect is both audible and tactile, and provides an indication that the self-locking coupling unit 10 has substantially reached its fully engaged condition.

As is clearly shown in FIG. 5, when the component parts of the self-locking coupling nut 10 are fully engaged the balls 52 are positioned substantially radially outwardly with respect ot their positioning when the components parts are disengaged. This in turn causes outward radial positioning of the spring 56. The spring 56 is dimensioned to that it entirely received within the groove 54 when the components parts of the self-locking coupling nut 10 are disengaged, and so that it projects outwardly beyond the confines of the groove 54 when the components parts are fully engaged. This positioning of the spring 56 provides both visual and tactile proof of the fully engaged and locked status of the self-locking coupling unit 10.

The spring 56 has a surface 58 that is fully exposed when the self-locking coupling nut 10 is in the locked status, but which is otherwise hidden from view by the walls of the groove 54. Likewise, the groove 19 of the first shell 12 is normally hidden, but is exposed when self-locking coupling nut 10 is in the locked status. The surface 58 and the groove 19 are preferably painted a bright color such as yellow to facilitate visual inspections and proof of the locked status of the self-locking coupling nut 10.

As is illustrated in dashed lines in FIG. 5, it is possible to provide the nut 14 with exterior dimensions such that the spring 56 does not project beyond the confines of the groove 54 even when the component parts of the self-locking coupling unit 10 are in the fully assembled and locked state. This variation in the dimensioning of a nut 14 is useful in those applications of the invention in which visual and tactile proof of the status of the device is considered unnecessary or undesirable.

Whenever it is desired to disengage the shell 66 from the shell 12, the nut 14 is rotated to disengage the threads 40 from the threads 72. Of course, the nut 14 cannot be rotated unless sufficient torque is developed to overcome the detenting action of the spring 56, the balls 52 and the grooves 32. As the self-locking coupling nut 10 is returned to its unlocked status, the component parts of the shell 10 and the nut 14 are returned to the positions shown in FIG. 4 under the action of the spring 48.

Figure 6:
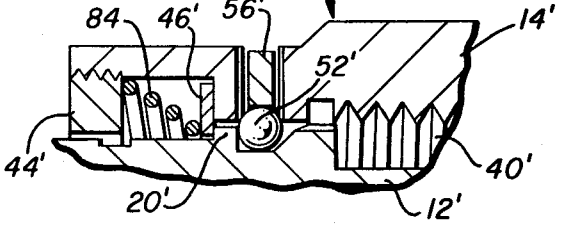
FIGS. 6 and 7 are views similar to FIGS. 4 and 5 illustrating an alternative embodiment of the invention.
Figure 7:
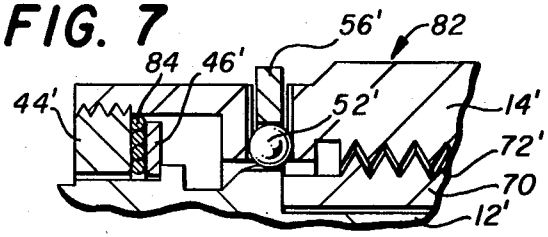

A self-locking coupling unit 82 comprising a second embodiment of the invention is illustrated in FIGS. 6 and 7. Many of the component parts of the self-locking coupling nut 82 are substantially identical in construction and function to component parts of the self-locking coupling nut 10. Such identical component parts are designated in FIGS. 6 and 7 with the same reference numerals utilized hereinabove in the description of the self-locking coupling nut 10, but are differentiated therefrom by means of a prime (') designation.

The self-locking coupling nut 82 differs from the self-locking coupling unit 10 primarily in the substitution of a coil spring 84 for the wave-shaped spring 48 of the self-locking coupling unit 10. Again, the coil spring 84 is trapped between the retaining ring 44' and the thrust washer 46', and is adapted to be substantially compressed when the component parts of the self-locking coupling nut 82 are assembled. Other types of springs adapted for compression between the retaining ring and the thrust waher may also be utilized in the practice of the invention.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

I claim:

1. A self-locking coupling nut comprising:

a first cylindrical shell including a radially inwardly located, axially extending ball receiving surface, a ball camming surface extending angularly outwardly from the ball receiving surface, and a plurality of ball receiving grooves intersecting the ball camming surface and positioned at spaced intervals around the periphery of the first shell, the innermost surface of each ball receiving groove positioned radially outwardly from the ball receiving surface, each adjacent pair of ball receiving grooves being separated by a land;

a second cylindrical shell for mating engagement with the first shell and having external threads thereon;

cooperating surfaces on the first and second shells for locating the shells with respect to each other upon mating engagement therebetween;

a nut surrounding the first shell and having threads for threadedly engaging the threads of the second shell to secure the first and second shells in mating engagement, a plurality of radially extending ball receiving apertures each initialy aligned with the ball receiving surface of the first shell, and a circumferentially extending spring receiving slot intersecting each of the ball receiving apertures;

a plurality of balls each positioned in one of the ball receiving apertures of the nut for movement therewith from initial engagement with the ball receiving surface of the first shell up the ball camming surface thereof and into engagement with the ball receiving grooves in response to threaded engagement of the nut with the second shell thereby locking the nut until a force sufficient to urge the balls up and over the lands separating the ball receiving grooves is applied; and a spring positioned in the spring receiving slot of the nut for retaining the balls in the ball receiving apertures and for urging the balls inwardly toward the first shell, the spring being cammed outwardly as the balls move up the ball camming surface into the ball receiving grooves thereby indicating the locked condition of the self-locking coupling nut.

2. The self-locking coupling nut according to claim 1 further including:

a thrust ring mounted on the first shell and having an axially facing thrust surface;

a retaining ring mounted on the nut for movement therewith relative to the first shell; and a spring trapped between the thrust surface of the thrust ring of the first shell and the retaining ring of the nut for axial compression as the nut threadedly engages the second shell.

3. The self-locking coupling nut according to claim 1 wherein the axial dimension of the spring receiving slot in the nut is matched to the axial dimension of the spring received therein so that the spring is cammed outwardly from the slot as the balls enter the ball receiving grooves to provide visual and tactile proof of the locked condition of the self-locking coupling nut.

4. The self-locking coupling nut according to claim 1 wherein the axial dimension of the slot in the nut is greater than the axial dimension of the spring received therein so that the spring is contained within the slot regardless of the locked or unlocked status of the self-locking coupling nut.

5. A self-locking coupling nut comprising:

a first cylindrical shell including a radially inwardly located, axially extending ball receiving surface, a ball camming surface extending angularly outwardly from the ball receiving surface, and a plurality of ball receiving grooves intersecting the ball camming surface and positioned at spaced intervals around the periphery of the first shell, the innermost surface of each ball receiving groove positioned radially outwardly from the ball receiving surface, each adjacent pair of ball receiving grooves being separated by a land;

a second cylindrical shell for mating engagement with the first shell and having external threads thereon;

cooperating surfaces on the first and second shells for locating the shells with respect to each other upon mating engagement therebetween;

a nut surrounding the first shell and having threads for threadedly engaging the threads of the second shell to secure the first and second shells in mating engagement, a plurality of radially extending ball receiving apertures each initially aligned with the ball receiving surface of the first shell, and a circumferentially extending spring receiving slot intersecting each of the ball receiving apertures;

a plurality of balls each positioned in one of the ball receiving apertures of the nut for movement therewith from initial engagement with the ball receiving surface of the first shell up the ball camming surface thereof and into engagement with the ball receiving grooves in response to threaded engagement of the nut with the second shell thereby locking the nut until a force sufficient to urge the balls up and over the lands separating the ball receiving grooves is applied;

a spring positioned in the spring receiving slot of the nut for retaining the balls in the ball receiving apertures and for urging the balls inwardly toward the first shell, the spring being cammed outwardly as the balls move up the ball camming surface and into the ball receiving grooves thereby indicating the locked condition of the self-locking coupling nut;

a thrust ring mounted on the first shell and having an axially facing thrust surface;

a retaining ring mounted on the nut for movement therewith relative to the first shell;

a spring trapped between the thrust surface of the thrust ring of the first shell and the retaining ring of the nut for axial compression as the nut threadedly engages the second shell;

the axial dimension of the spring receiving slot in the nut being matched to the axial dimension of the spring received therein so that the spring is cammed outwardly from the slot as the balls enter the ball receiving grooves to provide visual and tactile proof of the locked condition of the self-locking coupling nut.

6. A self-locking coupling nut comprising:

a first cylindrical shell including a radially inwardly located, axially extending ball receiving surface, a ball camming surface extending angularly outwardly from the ball receiving surface, and a plurality of ball receiving grooves intersecting the ball camming surface and positioned at spaced intervals around the periphery of the first shell, the innermost surface of each ball receiving groove positioned radially outwardly from the ball receiving surface, each adjacent pair of ball receiving grooves being separated by a land;

a second cylindrical shell for mating engagement with the first shell and having external threads thereon;

cooperating surfaces on the first and second shells for locating shells with respect to each other upon mating engagement therebetween;

a nut surrounding the first shell and having threads for threadedly engaging the threads of the second shell to secure the first and second shells in mating engagement, a plurality of radially extending ball receiving apertures each initially aligned with the ball receiving surface of the first shell, and a circumferentially extending spring receiving slot intersecting each of the ball receiving apertures;

a plurality of balls each positioned in one of the ball receiving apertures of the nut for movement therewith from initial engagement with the ball receiving surface of the first shell up the ball camming surface thereof and into engagement with the ball receiving grooves in response to threaded engagement of the nut with the second shell, thereby locking the nut until a force sufficient to urge the balls up and over the lands separating the ball receiving grooves is applied;

a spring positioned in the spring receiving slot of the nut for retaining the balls in the ball receiving apertures and for urging the balls inwardly toward the first shell, the spring being cammed outwardly as the balls move up to the ball camming surface and into the ball receiving grooves; and means for indicating the locked condition of the self-locking coupling nut disposed around the periphery of the first shell, the indicating means being hidden from view until the balls have moved up the ball camming surface and into engagement with the ball receiving grooves.

7. The self-locking coupling nut according to claim 6 wherein the indicating means comprises a groove formed in and substantially around the circumference of the first shell.

8. The self-locking coupling nut according to claim 6 wherein the axial dimension of the spring receiving slot in the nut is matched to the axial position of the spring received therein so that the spring is cammed outwardly from the slot as the balls enter the ball receiving grooves to provide additional visual and tactile proof of the locked condition of the self-locking coupling nut.

9. The self-locking coupling nut according to claim 6 wherein the axial dimension of the slot in the nut is greater than the axial dimension of the spring received therein so that the spring is contained within the slot regardless of the locked or unlocked status of the self-locking coupling nut.

10. A self-locking coupling nut comprising:

a first cylindrical shell including a radially inwardly located, axially extending ball receiving surface, a ball camming surface extending angularly outwardly from the ball receiving surface, and a plurality of ball receiving grooves intersecting the ball camming surface and positioned at spaced intervals around the periphery of the first shell, the innermost surface of each ball receiving groove positioned radially outwardly from the ball receiving surface, each adjacent pair of ball receiving grooves being separated by a land;

a second cylindrical shell for mating engagement with the first shell and having external threads thereon;

cooperating surfaces on the first and second shells for locating the shells with respect to each other upon mating engagement therebetween;

a nut surrounding the first shell and having threads for threadedly engaging the threads of the second shell to secure the first and second shells in mating engagement, a plurality of radially extending ball receiving apertures each initially aligned with the ball receiving surface of the first shell, and a circumferentially extending spring receiving slot intersecting each of the ball receiving apertures;

a plurality of balls each positioned in one of the ball receiving apertures of the nut for movement therewith from inital enggement with the ball receiving surface of the first shell up the ball camming surface thereof and into engagement with the ball receiving grooves in response to threaded engagement of the nut with the second shell, thereby locking the nut until a force sufficient to urge the balls up and over the lands separating the ball receiving groove is applied;

a spring positioned in the spring receiving slot of the nut for retaining the balls in the ball receiving apertures and for urging the ball inwardly toward the first shell, the spring being cammed outwardly as the balls move up the ball camming surface and into the ball receiving grooves;

means for indicating the locked condition of the self-locking coupling nut disposed around the periphery of the first shell, the indicating means being hidden from view until the balls have moved up the ball camming surface and into engagement with the ball receiving grooves;

a thrust ring mounted on the first shell and having an axially facing thrust surface;

a retaining ring mounted on the nut for movement therewith relative to the first shell;

a spring trapped between the thrust surface of the thrust ring of the first shell and the retaining ring of the nut for axial compression as the nut threadedly engages the second shell.

11. The self-locking coupling nut according to claim 10 wherein the indicating means comprises a groove formed in and substantially around the circumference of the first shell.

12. The self-locking coupling nut according to claim 10 wherein the axial dimension of the spring receiving slot in the nut is matched to the axial dimension of the spring received therein so that the spring is cammed outwardly from the slot as the balls enter the ball receiving grooves to provide additional visual and tactile proof of the locked condition of the self-locking coupling nut.

13. The self-locking coupling nut according to claim 10 wherein the axial dimension of the slot in the nut is greater than the axial dimension of the spring received therein so that the spring is contained within the slot regardless of the locked or unlocked status of the self-locking coupling nut.

14. A self-locking coupling nut comprising:

a first cylindrical shell including a radially inwardly located, axially extending ball receiving surface, a ball camming surface extending angularly outwardly from the ball receiving surface, and a plurality of ball receiving grooves intersecting the ball camming surface and positioned at spaced intervals around the periphery of the first shell, the innermost surface of each ball receiving groove positioned radially outwardly from the ball receiving surface, each adjacent pair of ball receiving grooves being separated by a land;

a second cylindrical shell for mating engagement with the first shell and having external threads thereon;

cooperating surfaces on the first and second shells for locating the shells with respect to each other upon mating engagement therebetween;

a nut positioned along the first shell and having threads for threadedly engaging the threads of the second shell to secure the first and second shells in mating engagement, said nut further having a plurality of radially extending ball receiving apertures each initially aligned with the ball receiving surface of the first shell, and a circumferentially extending spring receiving slot intersecting each of the ball receiving apertures;

said nut normally overlying and hiding a predetermined portion of the outer surface of the first shell;

spring means for acting between said nut and first shell to urge the nut into a position relative to the first shell with the ball receiving apertures of the nut aligned with the ball receiving surface of the first shell, threaded engagement of the nut and second shell counteracting the force of said spring means;

a plurality of balls each positioned in one of the ball receiving apertures of the nut for movement therewith from initial engagement wit the ball receiving surface of the first shell up the ball camming surface thereof and into engagement with the ball receiving grooves in response to threaded engagement of the nut with the second shell; and a spring positioned in the spring receiving slot of the nut for retaining the balls in the ball receiving apertures and for urging the balls inwardly toward the first shell, the spring being cammed outwardly as the balls move up the ball camming surface into the ball receiving grooves to lock the coupling nut, axial movement of the nut relative to the first shell as the nut is threadedly engaged with the second shell into the locked position exposing said predetermined portion of the outer surface of the first shell to provide visual confirmation of locking.

15. The self-locking coupling nut of claim 14 wherein said spring means comprises a wave shaped spring.

16. The self-locking coupling nut of claim 14 wherein said spring means comprises a coil spring.

17. The self-locking coupling nut of claim 14 wherein said first shell forms an annular thrust surface perpendicular the direction of relative motion between the nut and the first shell, said nut defining an annular thrust surface perpendicular the direction of relative motion between the nut and first shell, said spring means comprising a spring trapped between the thrust surfaces of the first shell and nut.

18. A self-locking coupling nut comprising:

a first cylindrical shell including a radially outwardly extending thrust ring defining a thrust surface thereon, a radially inwardly located, axially extending ball receiving surface, a ball camming surface extending angularly outwardly from the ball receiving surface, and a plurality of ball receiving grooves intersecting the ball camming surface and positioned at spaced intervals around the periphery of the first shell, the innermost surface of each ball receiving groove positioned radially outwardly from the ball receiving surface, each adjacent pair of ball receiving grooves being separated by a land;

a second cylindrical shell for mating engagement with the first shell and having external threads thereon;

cooperating surfaces on the first and second shells for locating the shells with respect to each other upon mating engagement therebetween;

a nut positioned along the first shell and having threads for threadedly engaging the threads of the second shell to secure the first and second shells in mating engagement, a plurality of radially extending ball receiving apertures each initially aligned with the ball receiving surface of the first shell, and a circumferentially extending spring receiving slot intersecting each of the ball receiving apertures;

said nut normally covering and hiding a predetermined portion of the outer surface of the first shell;

a plurality of balls each positioned in one of the ball receiving apertures of the nut for movement therewith from initial engagement with the ball receiving surface of the first shell up the ball camming surface thereof and into engagement with the ball receiving grooves in response to threaded engagement of the nut with the second shell thereby locking the coupling nut;

a first spring positioned in the spring receiving slot of the nut for retaining the balls in the ball receiving apertures and for urging the balls inwardly toward the first shell, the first spring being cammed outwardly as the balls move up the ball camming surface and into the ball receiving grooves;

a retaining ring mounted on the nut and defining a thrust surface facing the thrust surface on the thrust ring on said first shell; and a second spring trapped between the nut and first shell and engaging the thrust surfaces of the nut and first shell to urge the nut into a position relative to the first shell with the radially extending ball receiving apertures aligned with the ball receiving surface of the first shell, threaded engagement of the nut and second shell to the locked position moving the nut axially along the first shell against the force of said second spring to expose said predetermined portion of the first shell to provide a visual proof that the coupling nut is locked.

19. The self-locking coupling nut of claim 18 wherein said second spring is a wave shaped spring.

20. The self-locking coupling nut of claim 18 wherein said second spring is a coil spring.

21. The self-locking coupling nut of claim 18 wherein the predetermined portion of the outer surface of the first shell comprises a circumferential groove.

* * * * *